US006264315B1

(12) United States Patent
Nozawa et al.

(10) Patent No.: US 6,264,315 B1
(45) **Date of Patent: *Jul. 24, 2001**

(54) INK TANK INK JET CARTRIDGE AND INK FILLING METHOD

(75) Inventors: Minoru Nozawa, Yokohama; Keiichiro Tsukuda, Kawasaki, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/059,392

(22) Filed: Apr. 14, 1998

(30) Foreign Application Priority Data

Apr. 28, 1997 (JP) ..... 9-111142

(51) Int. Cl.[7] ..... B41J 2/175
(52) U.S. Cl. ..... 347/86
(58) Field of Search ..... 347/85, 86, 87, 347/49

(56) References Cited

U.S. PATENT DOCUMENTS

| | | | | |
|---|---|---|---|---|
| 4,896,172 | | 1/1990 | Nozawa et al. | 347/17 |
| 4,908,636 | | 3/1990 | Saito et al. | 347/25 |
| 4,977,413 | | 12/1990 | Yamanaka et al. | 347/7 |
| 5,128,690 | | 7/1992 | Nozawa | 347/30 |
| 5,523,780 | | 6/1996 | Hirosawa et al. | 347/86 |
| 5,589,862 | * | 12/1996 | Ujita et al. | 347/87 |
| 5,619,239 | | 4/1997 | Kotaki et al. | 347/86 |
| 5,682,189 | * | 10/1997 | Takagi | 347/87 |
| 5,790,157 | * | 8/1998 | Higuma et al. | 347/85 |
| 6,102,533 | * | 8/2000 | Nozawa et al. | 347/86 |

FOREIGN PATENT DOCUMENTS

| | | | |
|---|---|---|---|
| 278 764 | * | 8/1988 | (EP) . |
| 5-23954 | | 2/1993 | (JP) . |
| 8-39820 | | 2/1996 | (JP) . |

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

In an ink tank including a receiving portion having a polyhedral shape and receiving an ink absorbing member to store ink therein, an ink supply opening formed in part of the receiving portion for supplying the ink stored in the ink absorbing member to the outside, and an open-air communication port formed in part of the receiving portion apart from the ink supply opening for making an inner space of the receiving portion open to be communicated with open air, the ink is filled into the ink absorbing member while the inner space of the receiving portion is held under depressurization, and a projection comprising at least two ribs extending over a distance substantially equal to a length of inner wall surfaces of the receiving portion is provided on at least one of the inner wall surfaces of the receiving portion, which has a maximum surface area, substantially at a center thereof. An ink jet cartridge made up of the ink tank and a recording head, and a method of filling the ink to the ink tank or the ink jet cartridge are also provided.

11 Claims, 10 Drawing Sheets

INK TANK INK JET CARTRIDGE AND INK FILLING METHOD

BACKGROUND OF THE INVENTION

1. Field of the Invention

The present invention relates to an ink tank for use in the field of ink jet recording, and an ink jet cartridge made up of the ink tank and an ink jet recording head which are combined into a one-piece structure. More particularly, the present invention relates to an ink tank and an ink jet cartridge in which a negative pressure generating member is used as an ink absorbing member.

The present invention also relates to a method of filling ink into the ink tank or the ink jet cartridge.

It is to be noted that the term "ink" used in this specification means a liquid containing, in addition to ink of a type ejected from an ink jet recording head, a printing property improving liquid such as a treatment liquid used for improving permeability of a sheet of recording paper to ink.

2. Description of the Related Art

In the field of ink jet recording, an ink jet cartridge, which is made up of a recording head and an ink tank combined into a one-piece structure and which is detachably mounted onto a recording apparatus, has been employed to render the recording apparatus smaller in size and relatively free from maintenance. Known ink jet cartridges are constructed, for example, by permanently combining a recording head and an ink tank into a one-piece structure, or by separately fabricating a recording head and an ink tank and then combining them into a one-piece structure when used.

In any of the above conventional constructions of ink jet cartridges, the ink tank is required to have a mechanism for generating a back pressure (negative pressure) with respect to an ink flow supplied to the recording head so that ink is stably held in the tank and is supplied to the recording head in a stable manner during the recording process.

One of the simplest known methods of generating such a negative pressure is to employ a porous body, e.g., a urethane foam, as a negative pressure generating member (ink absorbing member) so as to utilize capillary attraction developed in the porous body. An ink tank for use in the above method generally comprises a receiving portion in which the ink absorbing member for storing ink is placed, an ink supply opening through which the ink is supplied to the ink absorbing member, and an open-air communication port through which air is taken into the receiving portion for allowing the ink to be smoothly supplied during the printing process.

As disclosed in Japanese Examined Patent Publication No. 5-23954, for example, one known ink tank of the above-described type is constructed by providing a rib to form a gap between an inner wall surface of the receiving portion and a corresponding surface of the ink absorbing member, and then communicating the gap with open air through an open-air communication port so that an air layer enclosed by the ink does not exist in the receiving portion.

The ink absorbing member to be placed in the receiving portion of the ink tank is preferably formed of a member that has been subjected to heat treatment and compression beforehand (referred to as a heat-compressed absorber hereinafter). When filling ink into an ink tank in which such a heat-compressed absorber is already placed, a depressurizing filling method is generally used to fill the ink. According to this filling method, ink is filled into the heat-compressed absorber by first depressurizing an inner space of the receiving portion of the ink tank which is not yet filled with ink. Next, ink is filled into the inner space of the receiving portion through the ink supply opening, and the ink spreads all over an entire surface of the heat-compressed absorber while maintaining a depressurized state in the receiving portion is maintained. Then, the inner space of the receiving portion is opened to communication with the open air after the injection of the ink is stopped.

Some ink tanks for use with ink jet cartridges are designed such that the ink tank is detachably mounted onto a carriage of the recording apparatus and has a narrow width in the scan direction of the carriage, so as to increase an amount of ink that can be stored in a limited space inside the recording apparatus. This type of ink tank therefore has a thin and flat outer configuration in a direction perpendicular to the scan direction of the carriage.

As a result of experiments, the inventors found that when ink is filled into the above-mentioned flat, thin ink tank by the depressurizing filling method, there may occur a phenomenon below.

Specifically, when the ink tank is depressurized, walls of a receiving portion of the ink tank, which are relatively weak in strength, may be deformed inward or toward a porous body (ink absorbing member) in the receiving portion such that the inner wall surfaces of the receiving portion come into contact with the ink absorbing member. For ink tank 301 that is flat and thin as shown in FIG. 16, in particular, those ones 302W (referred to as maximum area wall surfaces hereinafter) of inner wall surfaces defining receiving portion 302*a* in housing 302, which have a maximum surface area, are apt to deform or warp inward (i.e., in respective directions of arrows X), whereupon 302*a* maximum area wall surfaces 302W of receiving portion 302*a* are brought into contact with corresponding surfaces of ink absorbing member 303 over large regions. If ink is injected into the ink tank while the tank is in the above contact state between maximum area wall surfaces 302W and ink absorbing member 303, the ink cannot infiltrate to the surfaces of ink absorbing member 303 located within the contact regions. If receiving portion 302*a* is then released from the depressurized state to be communicated with the open air in the above condition, the ink cannot evenly permeate into the ink absorbing member. In the worst case, the ink jet cartridge may suffer from a trouble in its ability of supplying the ink from the ink tank 301 to a recording head.

Such a phenomenon is more marked especially for an ink tank of the type wherein the maximum area wall surfaces of the receiving portion have a larger area than the total area of other wall surfaces adjacent to each of the maximum area wall surfaces. This problem was recognized for the first time by the inventors.

As a result of conducting further experiments, the inventors also found that, even with a single rib simply provided on each of the maximum area wall surfaces of the receiving portion as practiced in the prior art, the rib was buried in the ink absorbing member, and the contact region between the inner wall surface of the receiving portion and the corresponding surface of the ink absorbing member was not significantly reduced in size.

SUMMARY OF THE INVENTION

An object of the present invention is to provide an ink tank, an ink jet cartridge, and an ink filling method which can overcome the above-described problems encountered when ink is filled into an ink tank under depressurization.

As a result of conducting intensive studies with a view to achieve the above object, the inventors found that an area of contact between inner wall surfaces of a receiving portion of the ink tank and corresponding surfaces of an ink absorbing member in the receiving portion that occurred when filling ink into the ink tank under depressurization was reduced by providing a projection comprising a set of at least two ribs on, for example, each of those ones of the inner wall surfaces of the receiving portion, which have a maximum surface area, with a narrow spacing between the ribs. With this construction the ink was satisfactorily filled into the ink tank and permeated into the ink absorbing member efficiently.

In other words, the present invention provides an ink tank including a receiving portion having a polyhedral shape and receiving an ink absorbing member to store ink therein, an ink supply opening formed in part of the receiving portion for supplying the ink stored in the ink absorbing member to the outside, and an open-air communication port formed in part of the receiving portion apart from the ink supply opening for making an inner space of the receiving portion open to be communicated with open air, wherein the ink is filled into the ink absorbing member while the inner space of the receiving portion is held under depressurization, and a projection comprising at least two ribs extending over a distance substantially equal to a length of inner wall surfaces of the receiving portion is provided on at least one of the inner wall surfaces of the receiving portion, which has a maximum surface area, substantially at a center thereof.

In the above ink tank, the spacing between the ribs forming the projection is preferably in the range of 0.5 mm to 2.5 mm. The spacing between the ribs forming the projection may be varied in the direction of the length of the ribs.

Also, the ink supply opening may be formed in a wall surface of the receiving portion which intersects the extending direction of the projection.

Further, the spacing between the ribs forming the projection may be narrowed in an area of the receiving portion where the ink absorbing member is in a compressed state. The projection may be provided in plural number on at least one of the inner wall surfaces of the receiving portion having a maximum surface area with a spacing of 10 mm or less between two projections adjacent to each other. At least two receiving portions each being the same as the above receiving portion may be combined with each other, and the projection may be provided on each of those ones of inner wall surfaces of the receiving portions which separate an atmospheric pressure space and a depressurized space from each other when the combined receiving portions are depressurized.

The present invention also provides an ink jet cartridge comprising an ink tank having any of the features set forth above, and a recording head combined with the ink tank in a detachable manner.

In the above ink jet cartridge, the recording head may be fixed to a holder for holding the ink tank. The recording head may include an electrothermal transducer for generating thermal energy enough to cause film boiling of the ink.

The present invention also provides a method of filling ink to an ink tank including a receiving portion for receiving an ink absorbing member to store ink therein, an ink supply opening formed in part of the receiving portion for supplying the ink stored in the ink absorbing member to the outside, an open-air communication port formed in part of the receiving portion apart from the ink supply opening for making an inner space of the receiving portion open to be communicated with open air, and a projection comprising at least two ribs provided on at least one of inner wall surfaces of the receiving portion, which has a maximum surface area, substantially at a center thereof. The method comprises the steps of closing the open-air communication port and then depressurizing the inner space of the receiving portion through the ink supply opening; filling the ink into the inner space of the receiving portion through the ink supply opening while the inner space of the receiving portion is kept in a depressurized state, causing the ink to spread all over an entire surface of the ink absorbing member through at least one gap between the ribs; and closing the ink supply opening and then opening the open-air communication port to communicate the inner space of the receiving portion with the open air, causing the ink to permeate up to an innermost portion of the ink absorbing member from the entire surface thereof.

In the above ink filling method, the receiving portion of the ink tank may have a wall surface deforming toward a corresponding surface of the ink absorbing member under depressurization developed in the depressurizing step, and the projection may be provided on the inner side of the wall surface of the receiving portion.

This brief summery has been provided so that the nature of the invention may be understood quickly. A more complete understanding of the invention can be obtained by reference to the following detailed description of the preferred embodiments thereof in connection with the attached drawings.

DETAILED DESCRIPTION OF THE PREFERRED EMBODIMENTS

Preferred embodiments of the present invention are described hereunder with reference to the drawings.

(Embodiment 1)

Figure 1:
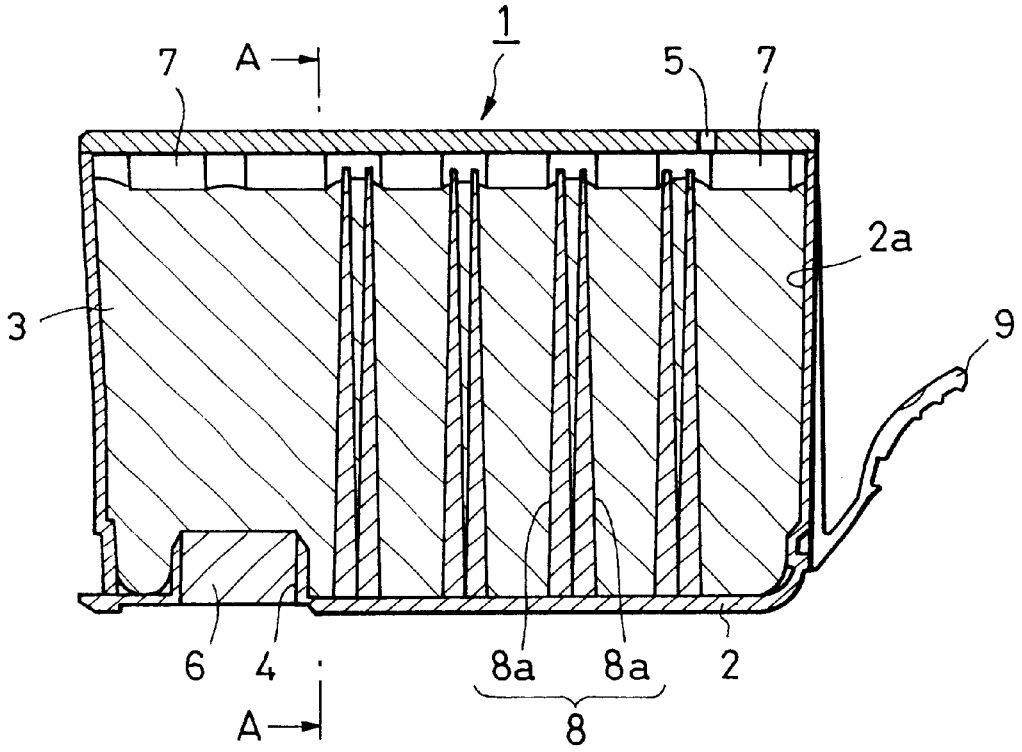
FIG. 1 is a sectional view of one embodiment of an ink tank according to the present invention.
Figure 2:
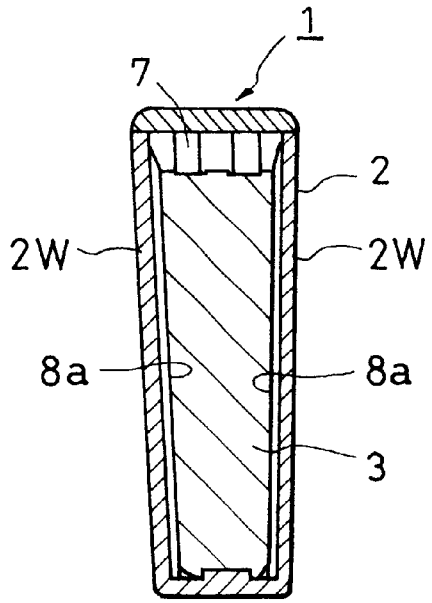
FIG. 2 is a sectional view taken along line A—A in FIG. 1.

FIG. 1 is a sectional view of one embodiment of an ink tank according to the present invention, and FIG. 2 is a sectional view taken along line A—A in FIG. 1.

In FIGS. 1 and 2, denoted by reference numeral 1 is a flat, thin ink tank. Ink tank 1 mainly comprises substantially rectangular housing 2 with receiving portion 2*a* formed therein to receive one kind of ink, ink absorbing member 3 placed in receiving portion 2*a* of housing 2 and serving as a negative pressure generating member, ink supply opening 4 formed in part of housing 2 for injecting the ink into receiving portion 2*a* and supplying the ink to the outside, and open-air communication port 5 formed in part of housing 2 apart from ink supply opening 4 for making an inner space of receiving portion 2*a* open to be communicated with the open air.

Ink supply member 6 formed of, e.g., a fibrous body, is plugged in ink supply opening 4. An ink supply tube (not shown) for supplying the ink to the side of a recording head (described later) is pushed against a lower surface of ink supply member 6, i.e., a surface of ink supply member 6 which is exposed to the outside through ink supply opening 4, so that the ink filled into ink absorbing member 3 can be stably supplied to the side of the recording head by capillary action.

A plurality of stub walls 7 are projected downward from an upper wall surface of housing 2 defining receiving portion 2*a* on the same side as open-air communication port 5. Stub walls 7 push at their lower ends an upper surface of ink absorbing member 3 to form an inner vacant space in receiving portion 2*a* around open-air communication port 5, the inner vacant space serving to prevent leakage of the ink.

In this embodiment, on the inner sides of maximum area wall surfaces 2W of housing 2 defining receiving portion 2*a*, there are provided plural sets (four in this embodiment) of projections 8, each set comprising two ribs 8*a* arranged substantially parallel to each other. The spacing between ribs 8*a* is determined so as to form a gap, which is able to serve as an ink passage, between maximum area wall surfaces 2W of receiving portion 2*a* and corresponding surfaces of ink absorbing member 3 when ink absorbing member 3 is brought into contact with projections 8. Preferably, the gap is set to be in the range of 0.5 mm to 2.5 mm.

The spacing between ribs 8*a* is not necessarily constant in the direction of length of ribs 8*a*, so long as the spacing has a size large enough to form the ink passage as mentioned above. Near a compressed portion of ink absorbing member 3, the width of ribs 8*a* is changed to narrow the spacing therebetween. This narrowing is intended to prevent ribs 8*a* from being buried in ink absorbing member 3 in the compressed portion thereof and hence from failing to maintain the ink passage.

Additionally, in this embodiment, grip tab 9 preferably is provided on one side surface of housing 2 to be grasped by a user for holding ink tank 1 when ink tank 1 is attached and detached to and from a recording apparatus.

With this embodiment, as explained above, since projections 8 are provided on the inner sides of maximum area wall surfaces 2W of receiving portion 2*a*, a gap serving as the ink passage for allowing the ink to spread all over an entire surface of ink absorbing member 3 can be maintained between maximum area wall surfaces 2W of receiving portion 2*a* and the corresponding surfaces of ink absorbing member 3. The gap can be maintained even if maximum area wall surfaces 2W of receiving portion 2*a* are deformed inward to such an extent that projections come 8 into contact with the corresponding surfaces of ink absorbing member 3 when receiving portion 2*a* is depressurized in the process of filling the ink into ink tank 1.

This maintained gap ensures that the supplied ink spreads all over the entire surface of ink absorbing member 3 under depressurization. Accordingly, when the inner space of receiving portion 2*a* is communicated with open air, the ink can be sufficiently permeated into ink absorbing member 3 without leaving air trapped in the receiving portion 2a. The ink tank thus filled with the ink can supply the ink in a stable manner.

Also in this embodiment, ink supply opening 4 is formed in a wall surface of receiving portion 2*a* which intersects an extending direction of projection 8.

One example of a manner of filling the ink into an ink tank shown in FIGS. 1 and 2, described below.

First, open-air communication port 5 is closed and the inner space of receiving portion 2*a* is evacuated through ink supply opening 4. With the evacuation, a considerable amount of air contained in ink absorbing member 3 and ink supply member 6 is purged out. After continuing the evacuation until the inner space of receiving portion 2*a* is depressurized to a predetermined air pressure, the evacuation is stopped and the inner space of the receiving portion 2*a* is kept in a depressurized state.

Figure 3:
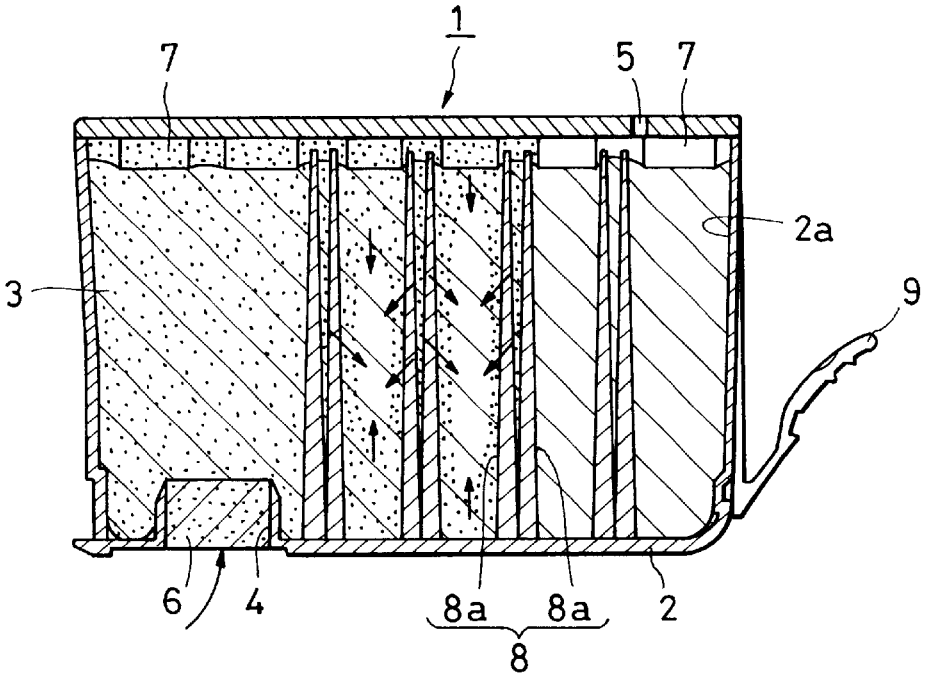
FIG. 3 is a sectional view for explaining how ink is filled into the ink tank shown in FIGS. 1 and 2.

Then, the ink is started to be filled under depressurization through ink supply opening 4. As shown in FIG. 3, while the ink in a free state is gradually filled into housing 2, the ink passages are maintained between maximum area wall surfaces 2W of receiving portion 2*a* and the corresponding surfaces of ink absorbing member 3. The ink passages are maintained by the presence of projections 8 provided on the inner sides of maximum area wall surfaces 2W.

Figure 4:
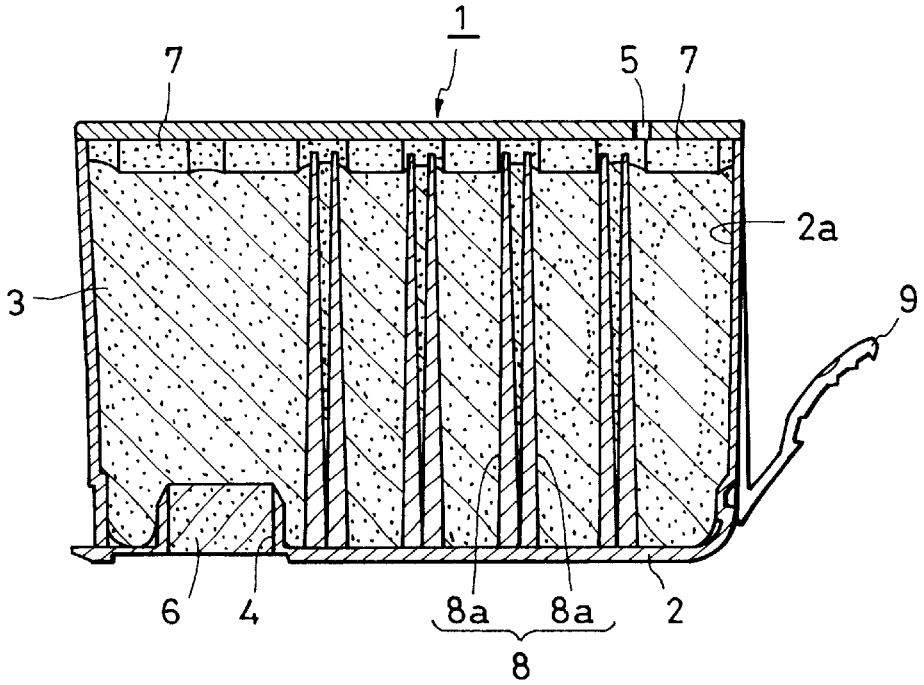
FIG. 4 is a sectional view for explaining how ink is filled into the ink tank shown in FIGS. 1 and 2.

The ink passages defined by projections 8 serve as points from which the ink starts to permeate into ink absorbing member 3, not only in the direction of length of ribs 8*a* forming projections 8, but also in a direction crossing the direction of length of ribs 8*a*. At the time the ink is permeated to such an extent as shown in FIG. 4, though the interior of ink absorbing member 3 is not yet completely filled with the ink, the filling of the ink is stopped and the inner space of receiving portion 2*a* is communicated with the open air. As a result, the ink is forced to fully permeate into an innermost portion of ink absorbing member 3 which has not yet been filled with the ink, thereby completing the filling of the ink tank.

Incidentally, the remaining ink may be purged out, if necessary, in a secondary step.

(Embodiment 2)

Figure 5:
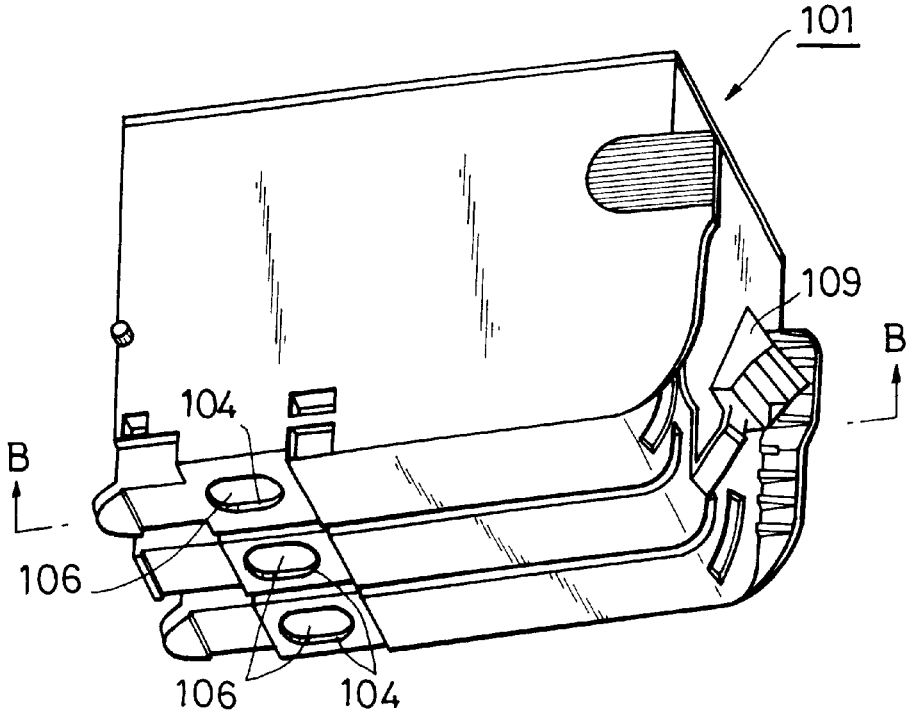
FIG. 5 is a schematic perspective view of another embodiment of the ink tank according to the present invention.
Figure 6:
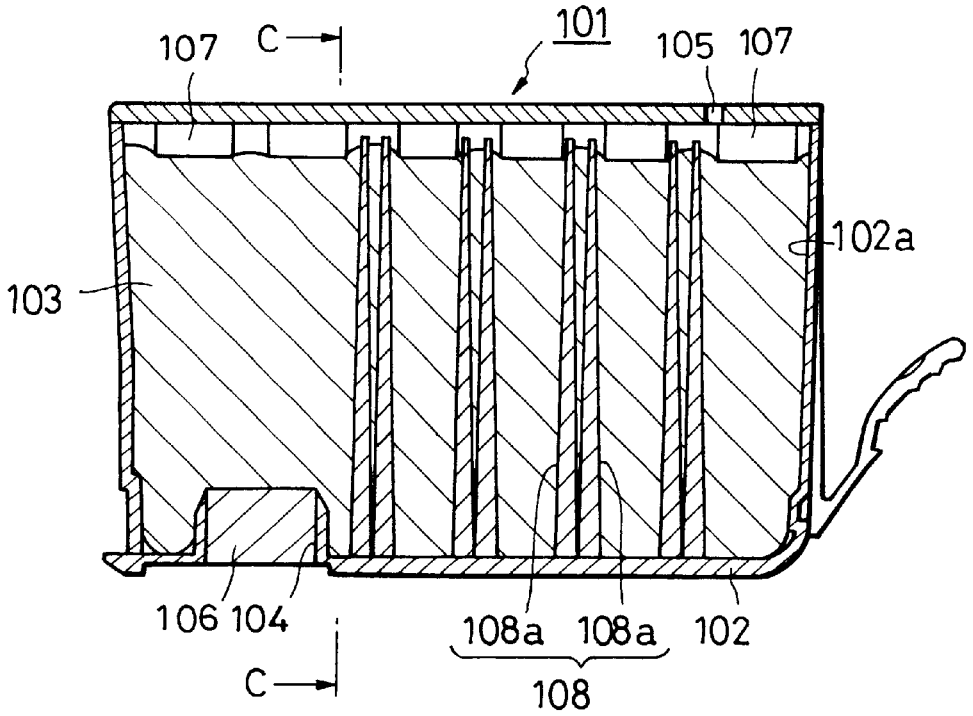
FIG. 6 is a sectional view taken along line B—B in FIG. 5.
Figure 7:
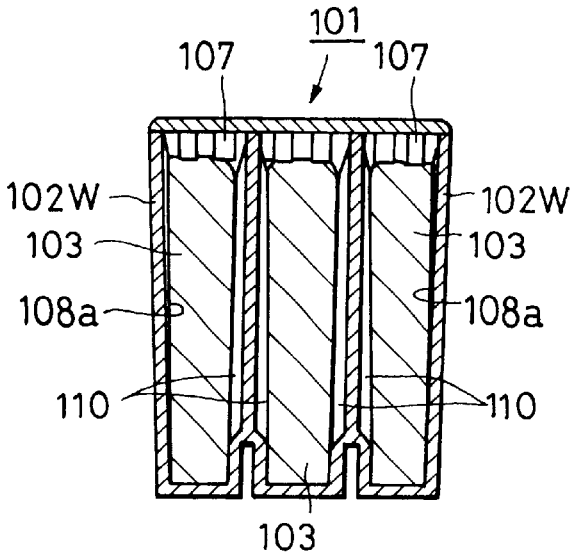
FIG. 7 is a sectional view taken along line C—C in FIG. 6.

FIG. 5 is a schematic perspective view of another embodiment of an ink tank according to the present invention. FIG. 6 is a sectional view taken along line B—B in FIG. 5, and FIG. 7 is a sectional view taken along line C—C in FIG. 6. Note that for brevity's sake, some ink tank components in this embodiment common to those in the above embodiment are not described here.

An ink tank of this embodiment is constructed by arranging three flat, thin housings, each being the same as the housing used in the above embodiment, and combining them into a one-piece structure. The ink tank of this embodiment is featured in that projections 108 are provided on each of inner surfaces of outer walls 102W of an outer two among the three housings. The outer walls 102W of the two housings, on each of which projections 108 are provided, are partition walls separating an atmospheric pressure space and a depressurized space from each other when the ink tank is depressurized for filling of the ink, and are possibly deformed inward of the respective housings. By providing projections 108 on each of the inner surfaces of the outer walls 102W, as mentioned above, ink passages for allowing the ink to spread all over the entire surface of ink absorbing member 103 can be formed between the inner surfaces of outer walls 102W and the corresponding surfaces of ink absorbing member 103.

Additionally, reference numeral 110 in FIG. 7 denotes a rib provided on each of inner and outer surfaces of opposite walls of the intermediate housing. Unlike ribs 108*a* forming projections 108, ribs 110 are arranged with large intervals therebetween so as to simply push the surfaces of ink absorbing member 103, thereby holding the member in place. When the ink is filled into the ink absorbing member under depressurization, the surfaces provided with ribs 110 are defined by partition walls locating between depressurized spaces, and hence the ribs according to the present invention are not necessarily provided on those surfaces. Of course, ribs 108*a* may be provided instead of ribs 110.

Because the ink tank of this embodiment comprises three housings combined into a one-piece structure, three kinds of ink can be stored in the three housings independently of one another. To that end, as shown in FIG. 5, ink supply opening 104, ink supply member 106 so on are provided for each housing.

Figure 8:
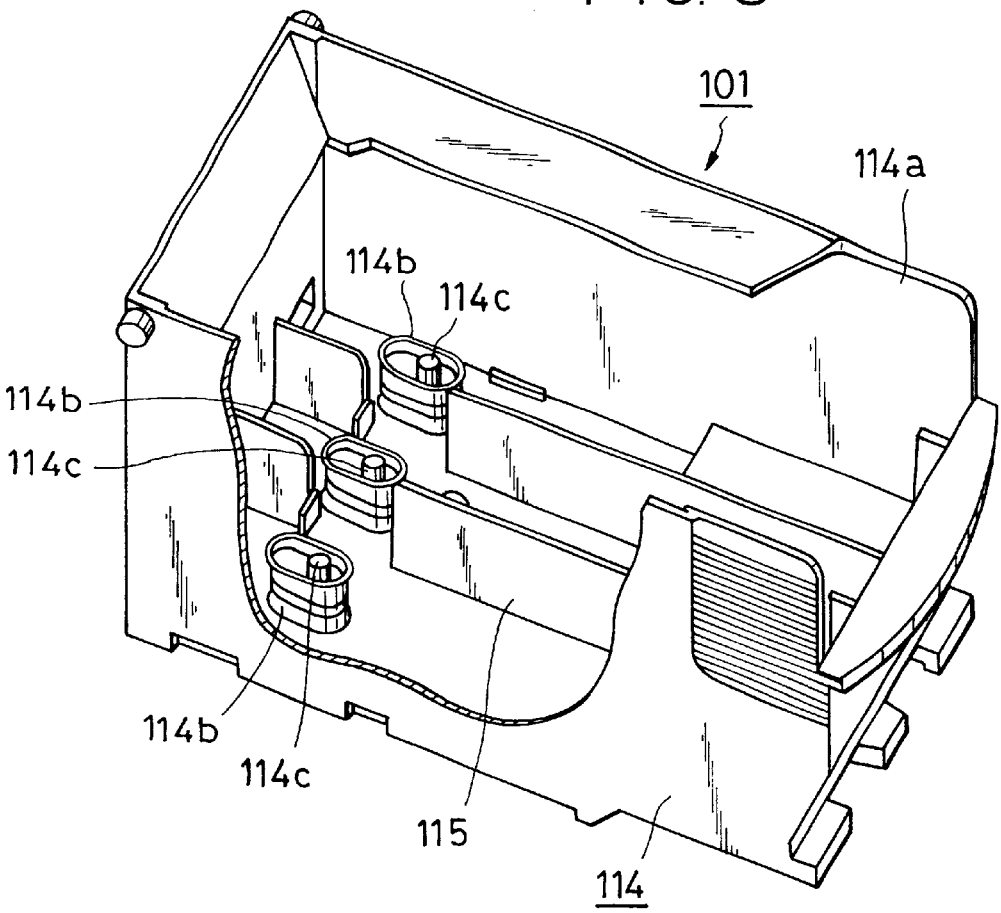
FIG. 8 is a perspective view of a head holder as viewed from above.
Figure 9:
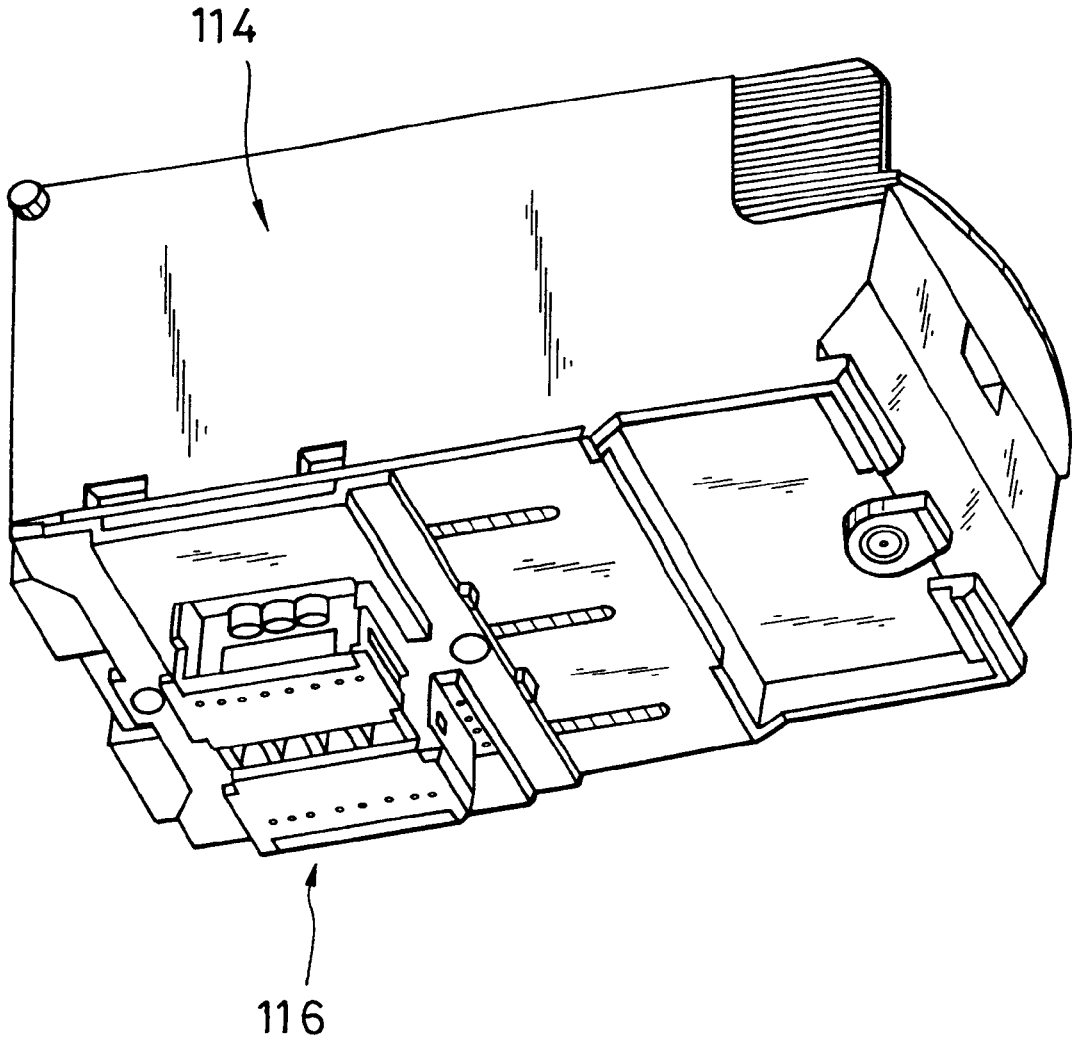
FIG. 9 is a perspective view of the head holder as viewed from below.

Ink tank 101 having the construction explained above can be loaded in, for example, head holder 114 shown in FIGS. 8 and 9. Head holder 114 mainly comprises housing 114*a* of size corresponding to the three housings for receiving ink tank 101, ink inlets 114*b* provided on an inner bottom surface of housing 114*a* and capable of being inserted into ink supply openings 104 in one-to-one relation, ink supply tubes 114*c* disposed in the respective ink inlets 114*b* and held in abutment with the lower ends of ink supply members 106 in one-to-one relation, ribs 115 for partitioning housing 114*a* into individual inner spaces corresponding the three housings of ink tank 101 in one-to-one relation, and recording head unit 116 provided on an outer bottom surface of housing 114*a* and including an electrothermal transducer for generating thermal energy enough to cause film boiling of the ink.

Head holder 114 thus constructed constitutes an ink jet cartridge in cooperation with ink tank 101, shown in FIG. 5, loaded therein, and the ink jet cartridge can be mounted on a recording apparatus described later.

(Embodiment 3)

Figure 10:
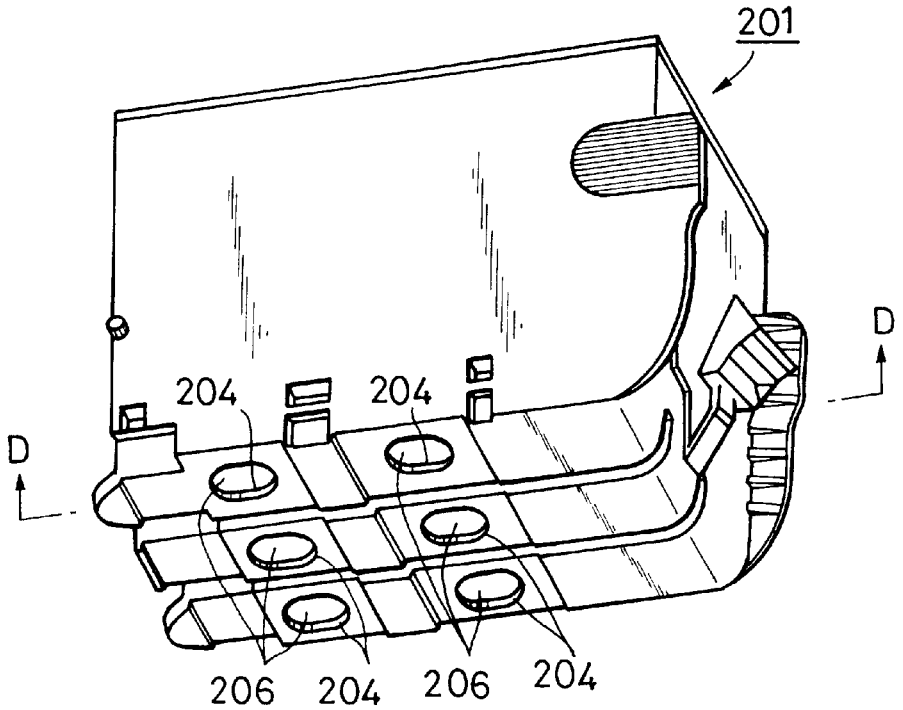
FIG. 10 is a schematic perspective view of still another embodiment of the ink tank according to the present invention.
Figure 11:
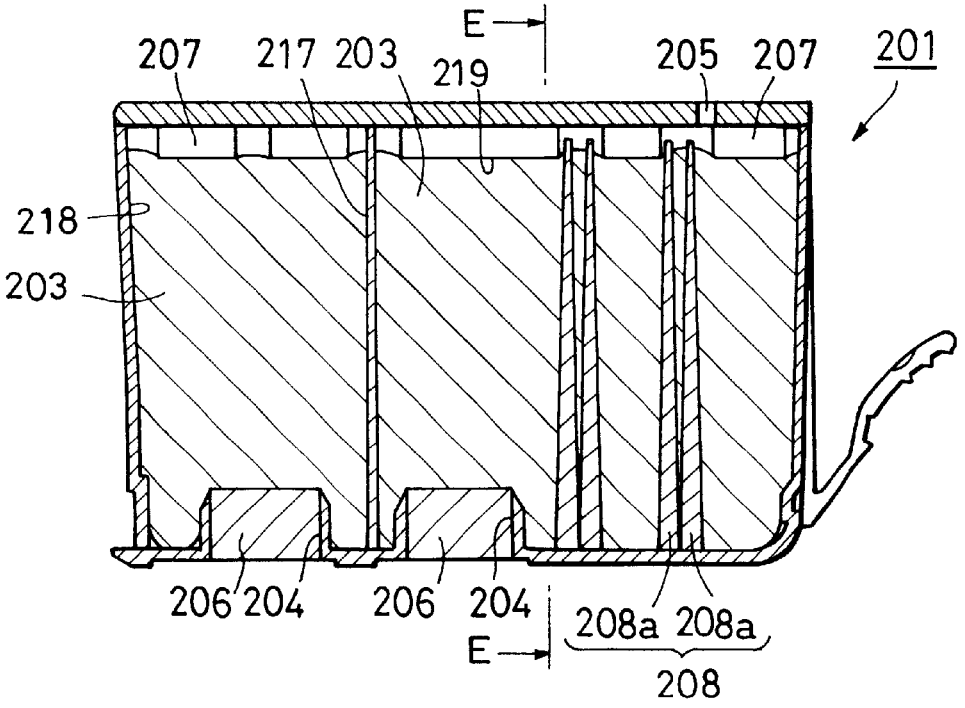
FIG. 11 is a sectional view taken along line D—D in FIG. 10.
Figure 12:
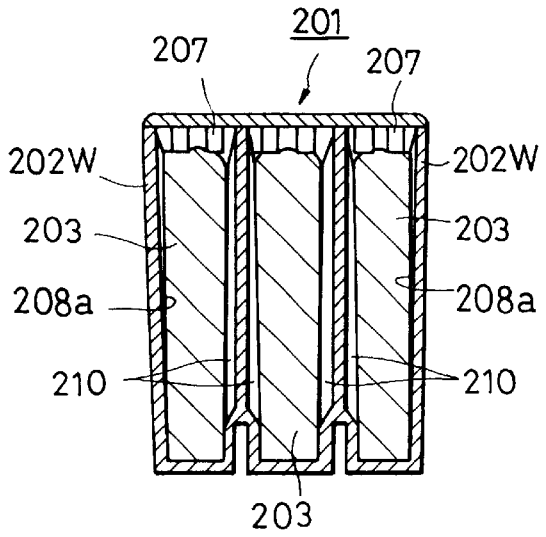
FIG. 12 is a sectional view taken along line E—E in FIG. 11.

FIG. 10 is a schematic perspective view of still another embodiment of an ink tank according to the present invention. FIG. 11 is a sectional view taken along line D—D in FIG. 10, and FIG. 12 is a sectional view taken along line E—E in FIG. 11. Note that for brevity's sake, some ink tank components in this embodiment common to those in the above embodiments are not described here.

An ink tank of this embodiment is featured in that, based on the ink tank of the above Embodiment 2, partition wall 217 is provided in each housing, as shown in FIG. 11, enabling the ink tank to store a total of six kinds of ink. Partition wall 217 in this embodiment divides an inner space of each housing into small chamber 218 spaced apart from grip tab 209 and large chamber 219 near grip tab 209.

Since walls defining small chamber 218 have a relatively small surface area and are deformed inward in small amount when the ink tank is depressurized for filling the ink, the inner wall surfaces of small chamber 218 are brought into contact with the corresponding surfaces of ink absorbing member 203 in a relatively small region. Projections 208 are therefore not provided on the inner wall surfaces of small chamber 218.

On the other hand, since walls defining large chamber 219 have a relatively large surface area and are deformed inward in large amount when the ink tank is depressurized for injection of the ink, the inner wall surfaces of large chamber 219 are brought into contact with the corresponding surfaces of ink absorbing member 203 in a relatively large region. Projections 208 are therefore provided on the inner wall surfaces of large chamber 219 to ensure ink passage for allowing the ink to spread all over the entire surface of ink absorbing member 203.

As an alternative, the inner space of each housing may be divided by the partition wall 217 into two chambers equal in size to each other. In this case, projections 208 may be provided on each of inner wall surfaces of both the chambers.

Figure 13:
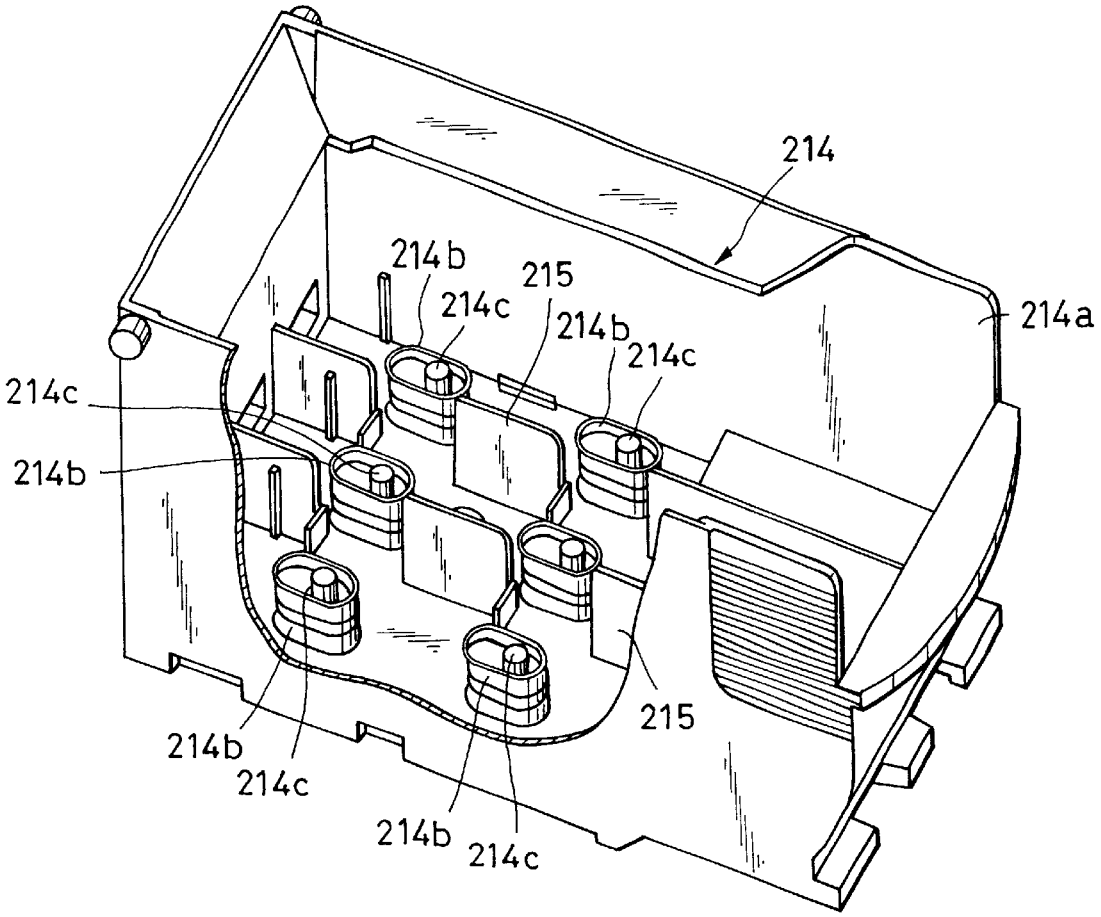
FIG. 13 is a perspective view of a head holder as viewed from above.
Figure 14:
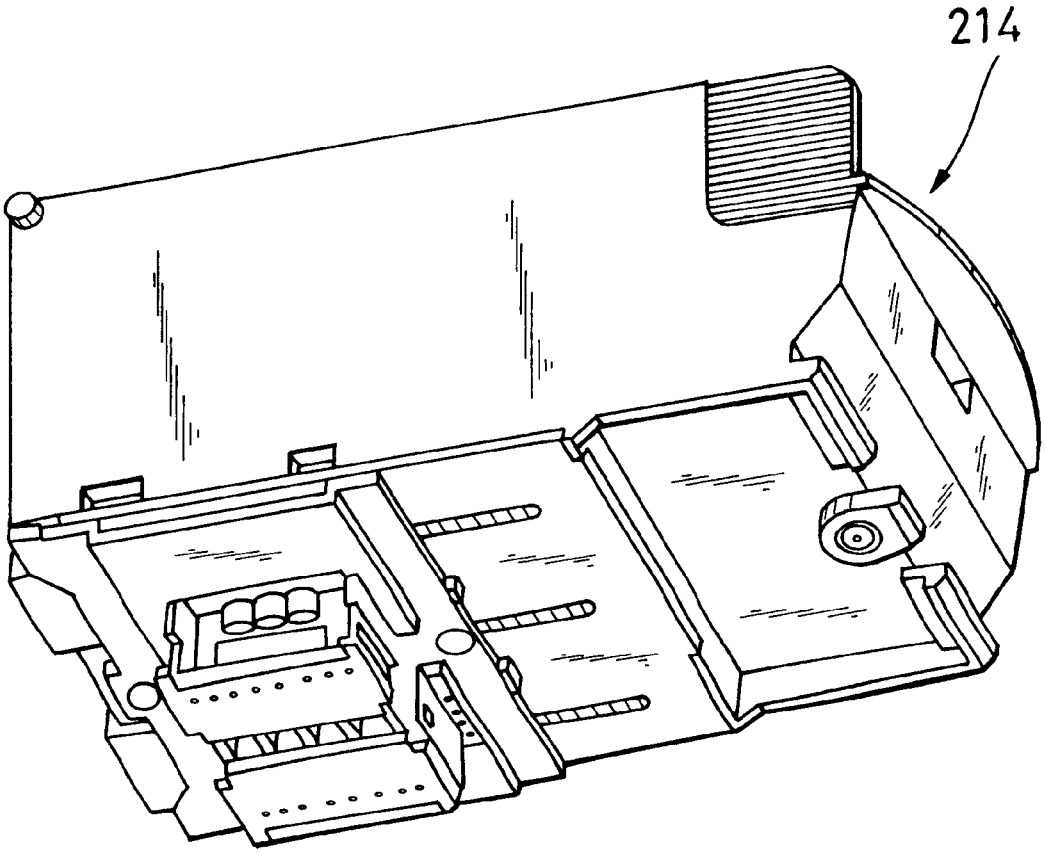
FIG. 14 is a perspective view of the head holder as viewed from below.

Ink tank 201 having the construction explained above can be loaded in head holder 214, for example, shown in FIGS. 13 and 14. Head holder 214 includes ink inlets 214*b* and ink supply tubes 214*c* corresponding to the number and positions of ink supply openings 204 and ink supply members 206 of ink tank 201.

A total of six kinds of ink in three colors, for example, may be filled into the six ink storing chambers in this embodiment such that ink of the same color is filled into one of three small chambers 218 and one of three large chambers 219 adjacent to the one small chamber through partition wall 217. Ink having normal density, i.e., deeper in color, can be filled into the small chamber 218, and the ink having lower density, i.e., lighter in color, can be filled into larger chamber 219. The reason why the deeper-color ink is filled into the small chamber 218 is described below.

When ink tank 201 of this embodiment is loaded in head holder 214, it is in such a state that small chamber 218 is located on the lower side and large chamber 219 is located on the upper side. If the ink should leak, the effect upon recording caused when the lighter-color ink in large chamber 219 is mixed with the deeper-color ink in small chamber 218 is smaller than that caused in the case opposite to the above.

One example of a recording apparatus onto which the ink tank or the ink jet cartridge of the present invention can be mounted will now be described with reference to FIG. 15.

Figure 15:
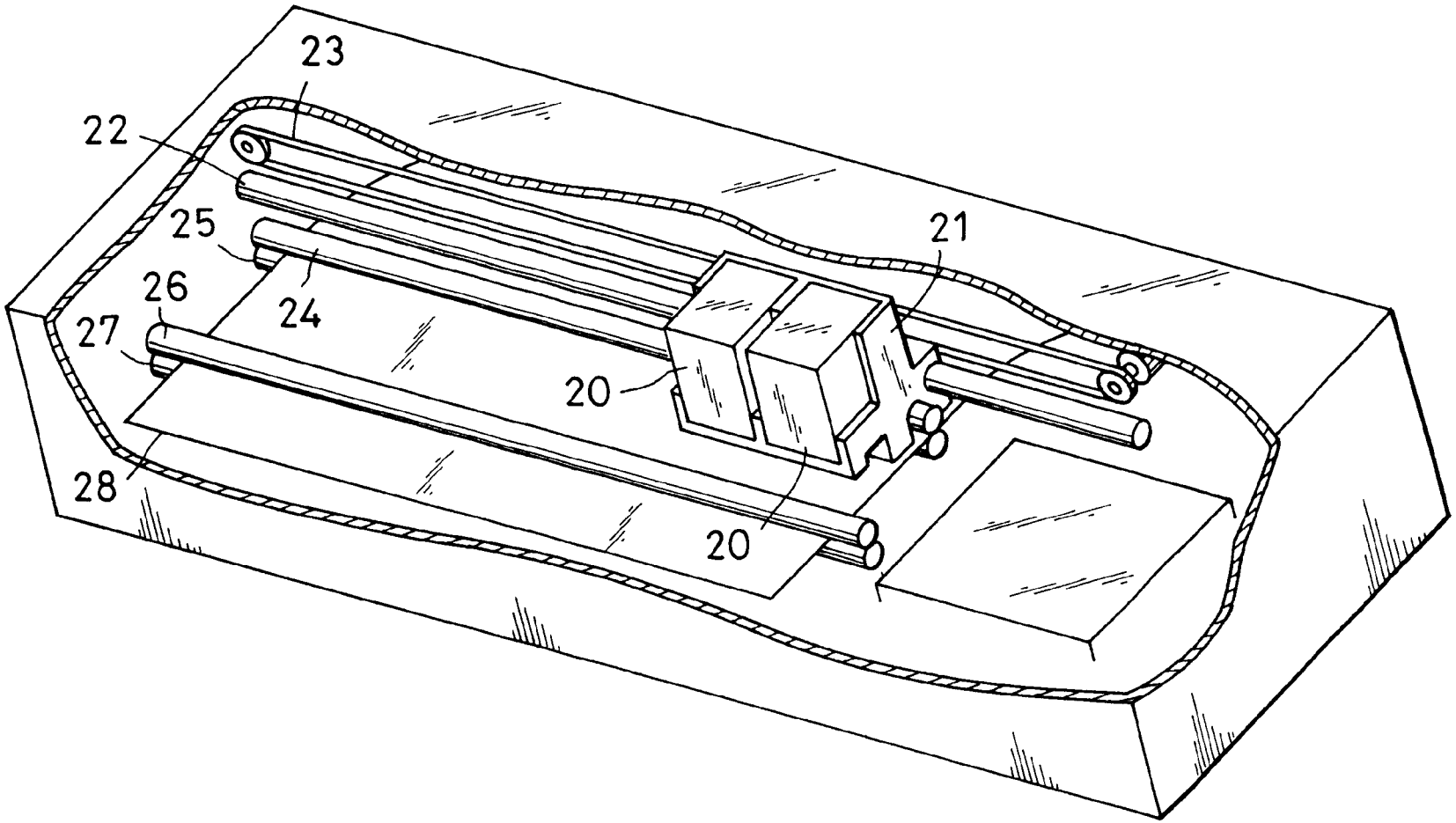
FIG. 15 is a perspective view, partly broken, showing one example of a recording apparatus onto which the ink tank of the present invention can be mounted.
Figure 16:
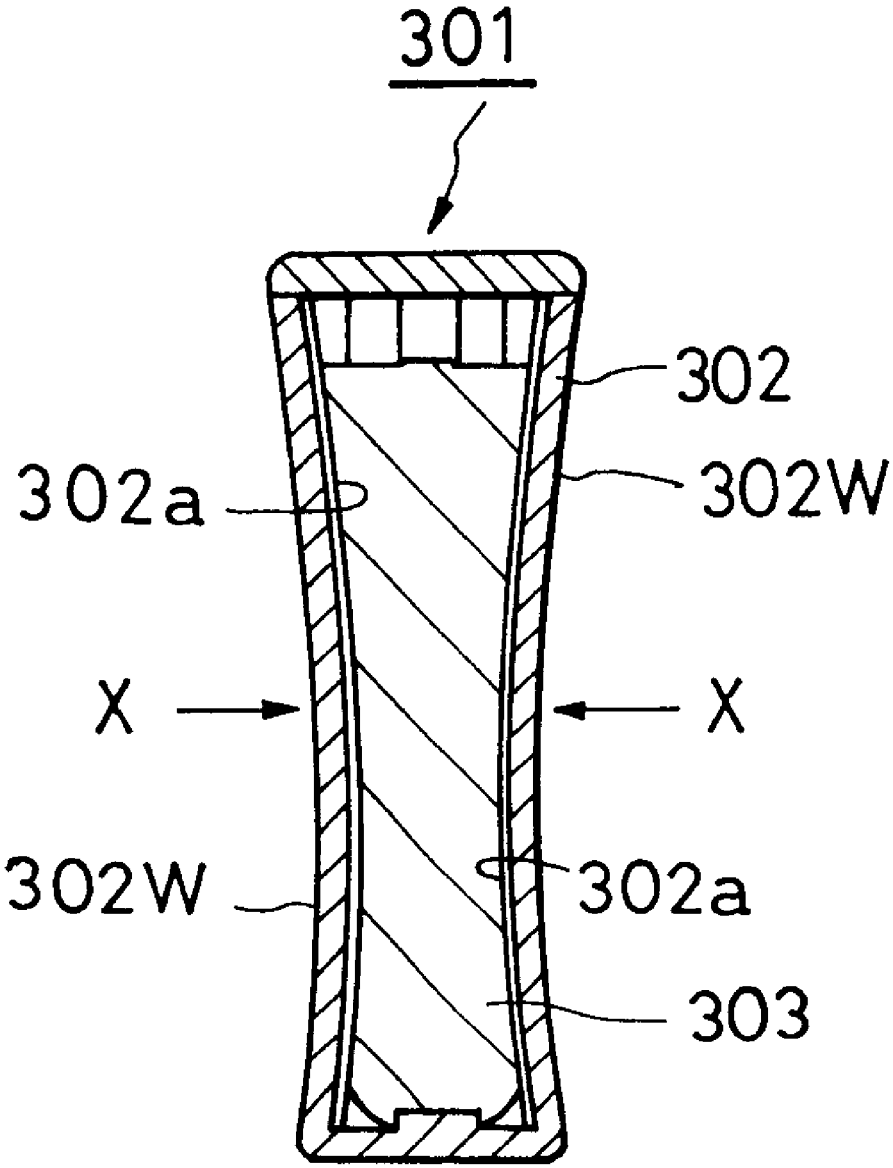
FIG. 16 PRIOR ART
FIG. 16 is a sectional view showing a conventional ink tank in a deformed state under depressurization.

FIG. 15 is a schematic perspective view, partly broken, showing a recording apparatus to which the present invention is applied. In FIG. 15, denoted by 20 is an ink jet cartridge that is the same as one of those described above and that comprises an ink tank portion on the upper side, a head holder provided with a recording head on the lower side, and a connector (not shown) for receiving, e.g., a signal to drive the recording head. Denoted by 21 is a carriage on which two ink jet cartridges 20 are mounted while being properly positioned, and which has a connector holder for transmitting, e.g., the signal to drive the recording head. Carriage 21 is electrically connected to the recording head through the connector holder.

Two ink jet cartridges 20 used in this embodiment preferably comprise a right cartridge having an ink tank storing six kinds of ink, including both deeper-color and lighter-color yellow, magenta and cyan, and a left cartridge having an ink tank storing black ink and a printing property improving liquid. Denoted by 22 is a scan rail extending in the direction of main scan of carriage 21, and denoted by 23 is a driving belt for transmitting driving forces to move carriage 21 in a reciprocal manner. Denoted by 24, 25; 26, 27 are pairs of feed rollers disposed rearward and forward of the recording position of the recording head, respectively, for feeding a recording medium while nipping it between the paired rollers, and denoted by 28 is a recording medium, e.g., a sheet of paper, held in pressure contact with a platen (not shown) for keeping flat a surface of the recording medium on which printing is to be made.

In the printing process, the recording head unit of ink jet cartridge 20 is projected downward from carriage 21 to a position between the pair of recording medium feed rollers 24 and 25, and an ejection port forming surface of the recording head unit is positioned parallel to recording medium 28 held in pressure contact with a guide surface of the platen (not shown).

According to the present invention, as described above, since a projection comprising at least two ribs arranged with a small spacing therebetween are provided on each of inner walls surfaces of an ink tank which are apt to easily deform when ink is filled into the ink tank. under depressurization, ink passages for allowing the ink to spread all over an entire surface of an ink absorbing member are formed between the inner wall surfaces of the ink tank and corresponding surfaces of the ink absorbing member. The presence of the ink passages enables the ink to fully permeate into an innermost portion of the ink absorbing member. The ink tank or the ink jet cartridge thus sufficiently filled with the ink can supply the ink to a recording head in a stable manner when mounted onto a recording apparatus.

The invention has been described with respect to particular illustrative embodiments. It is to be understood that the invention is not limited to the above described embodiments and that various charges and modifications may be made by those of ordinary skill in the art without departing from the spirit and scope of the invention.

What is claimed is:

1. An ink tank including a receiving portion having a polyhedral shape and receiving an ink absorbing member to store ink therein, an ink supply opening formed in part of said receiving portion for supplying the ink stored in said ink absorbing member to the outside, and an open-air communication port formed in part of said receiving portion apart from said ink supply opening for making an inner space of said receiving portion communicated with open air, wherein said inner space of said receiving portion is defined by inner wall surfaces including at least a bottom wall and a side wall with said side wall having a maximum surface area, wherein said ink supply opening is disposed in said bottom wall, wherein said side wall has formed thereon a projection comprising at least two ribs extending over a distance substantially equal to a length of said side wall, with said at least two ribs both being arranged substantially at a center of said side wall with a space therebetween, wherein said ink absorbing member is more compressed near to said bottom wall than away from said bottom wall, and wherein the space between said at least two ribs is smaller near to said bottom wall than away from said bottom wall.

2. The ink tank according to claim 1, wherein the space between said at least two ribs forming said projection is in the range of 0.5 mm to 2.5 mm.

3. The ink tank according to claim 1, wherein plural projections are provided on said side wall, each said projection comprising at least two ribs extended over a distance substantially equal to a length of said side wall with a space therebetween. the space being smaller near the bottom wall than away from the bottom wall, with a spacing of 10 mm or less between two projections adjacent to each other.

4. The ink tank according to claim 1, further comprising a combined receiving portion formed from at least two receiving portions each being the same as said receiving portion combined with each other, and a further projection provided on each of those ones of inner wall surfaces of said combined receiving portion which separate an atmospheric pressure space and a depressurized space from each other when said combined receiving portions are depressurized.

5. An ink jet cartridge comprising an ink tank according to claim 1, and a recording head combined with said ink tank in a detachable manner.

6. The ink jet cartridge according to claim 5, wherein said recording head is fixed to a holder for holding said ink tank.

7. The ink jet cartridge according to claim 6, wherein said recording head includes an electrothermal transducer for generating thermal energy enough to cause film boiling of the ink.

8. The ink tank according to claim 1, further comprising a plurality of projections.

9. An ink tank according to claim 1, wherein a cross-sectional shape of each rib in the direction parallel to said side wall is trapezoidal with the length of the base near the bottom wall being longer than the base away from the bottom wall.

10. A method of filling ink to an ink tank including a receiving portion for receiving an ink absorbing member to store ink therein, an ink supply opening formed in part of said receiving portion for supplying the ink stored in said ink absorbing member to the outside, an open-air communication port formed in part of said receiving portion apart from said ink supply opening for making an inner space of said receiving portion communicated with open air, and a projection, wherein the inner space of said receiving portion is defined by inner wall surfaces including at least a bottom wall and a side wall with said side wall having a maximum side area and with said ink supply opening in said bottom wall, and wherein said projection comprises at least two ribs provided on said side wall with said at least two ribs both being arranged substantially at a center of said side wall with a space therebetween, the space being smaller near the bottom wall than away from the bottom wall, the ink absorbing member being more compressed near to the bottom wall than away from the bottom wall, said method comprising the steps of:

closing said open-air communication port;

depressurizing the inner space of said receiving portion through said ink supply opening;

filling the ink into the inner space of said receiving portion through said ink supply opening while the inner space of said receiving portion is kept in a depressurized state, whereby the ink spreads all over an entire surface of said ink absorbing member through the space between said ribs;

closing said ink supply opening; and opening said open-air communication port to communicate the inner space of said receiving portion with the open air, causing the ink to permeate up to an innermost portion of said ink absorbing member from the entire surface thereof.

11. The ink injection method according to claim 10, wherein said receiving portion of said ink tank has a wall surface deforming toward a corresponding surface of said ink absorbing member under depressurization developed in said depressurizing step, and said projection is provided on the inner side of the wall surface of said receiving portion.

* * * * *

UNITED STATES PATENT AND TRADEMARK OFFICE

CERTIFICATE OF CORRECTION

PATENT NO. : 6,264,315 B1
DATED : July 24, 2001
INVENTOR(S) : Minoru Nozawa et al.

It is certified that error appears in the above-identified patent and that said Letters Patent is hereby corrected as shown below:

Column 5,
Line 66, change "come 8" to -- 8 come --.

Column 7,
Line 23, change "so on" to -- and so on --.

Column 8,
Line 3, change "in" to -- in a --; and
Line 14, change "both the" to -- both --.

Column 9,
Line 28, change "charges" to -- changes --; and
Line 65, change "therebetween." to -- therebetween, --.

Signed and Sealed this

Twelfth Day of March, 2002

*Attest:*

*Attesting Officer*

JAMES E. ROGAN
*Director of the United States Patent and Trademark Office*